US007893336B2

(12) United States Patent
Chang et al.

(10) Patent No.: US 7,893,336 B2
(45) Date of Patent: Feb. 22, 2011

(54) ILLUMINATED MUSICAL CONTROL CHANNEL CONTROLLER

(76) Inventors: Henry Chang, 606, 3rd Ave., #126, San Diego, CA (US) 92101; Erik Stauber, 3437 Arizona St., San Diego, CA (US) 92104

( * ) Notice: Subject to any disclaimer, the term of this patent is extended or adjusted under 35 U.S.C. 154(b) by 1 day.

(21) Appl. No.: 12/353,493

(22) Filed: Jan. 14, 2009

(65) Prior Publication Data

US 2010/0175542 A1 Jul. 15, 2010

(51) Int. Cl.
*A63J 17/00* (2006.01)
*G10H 7/00* (2006.01)

(52) U.S. Cl. ..... 84/464 A; 84/645

(58) Field of Classification Search ..... 84/464 R, 84/464 A, 645
See application file for complete search history.

(56) References Cited

U.S. PATENT DOCUMENTS

| | | | | |
|---|---|---|---|---|
| 5,502,276 | A * | 3/1996 | Jameson | 84/645 |
| 6,011,212 | A * | 1/2000 | Rigopulos et al. | 84/667 |
| 6,388,183 | B1 * | 5/2002 | Leh | 84/645 |
| 7,227,075 | B2 * | 6/2007 | Chang et al. | 84/645 |

* cited by examiner

*Primary Examiner*—Jeffrey Donels
(74) *Attorney, Agent, or Firm*—Gordon & Rees LLP

(57) ABSTRACT

An illuminated controller for a musical control channel, having: a light transmitting body; a mounting system holding a bottom end of the light transmitting body such that the light transmitting body can be positioned at different angular positions; a handle at a top end of the light transmitting body; at least one light source positioned to illuminate the light transmitting body; and an actuator connected to the mounting system, wherein the actuator translates the angular position of the light transmitting body into a signal for controlling a musical control channel.

11 Claims, 3 Drawing Sheets

ILLUMINATED MUSICAL CONTROL CHANNEL CONTROLLER

TECHNICAL FIELD

The present invention relates to musical instruments, and in particular to MIDI (Musical Instrument Digital Interface) controllers for musical instruments.

SUMMARY OF THE INVENTION

The present invention provides an illuminated controller for controlling a musical control channel of a MIDI or MIDI-type device, comprising: a light transmitting body; a mounting system holding a bottom end of the light transmitting body such that the light transmitting body can be positioned at different angular positions; a handle at a top end of the light transmitting body; at least one light source positioned to illuminate the light transmitting body; and an actuator connected to the mounting system, wherein the actuator translates the angular position of the light transmitting body into a signal for controlling a musical control channel.

In operation, a musician grasps onto the handle and moves the controller to different angular positions. Such movement causes the controller to send different signals to a MIDI (Musical Instrument Digital Interface) or MIDI-type controller to vary a musical control channel. MIDI is an industry-standard protocol defined in 1983 that enables electronic musical instruments, computers and other equipment to communicate, control, and synchronize with each other. Examples of MIDI control channels are well known in the art, and may include sound characteristics such as volume, pitch, vibrato, tempo, panning, etc.

In accordance with the present invention, the musician can control a musical channel (for example, "pitch" or "vibrato") by moving the illuminated controller to various positions. In one example, the musician may increase the pitch of the music by raising the free end of the illuminated controller, and may decrease the pitch of the music by lowering the free end of the illuminated controller. In this respect, the present controller functions much like a standard dial or slider switch on a MIDI controller. It is to be understood that the present controller is not limited to controlling any particular musical control channel (such as "pitch" or "vibrato"). Rather, the present controller can be used to control any desired controller for a MIDI or MIDI-type controller. Moreover, the present controller can be used to control different control musical channels at different times. It all depends upon how the present (illuminated) controller is connected to a standard MIDI or MIDI-type controller. The possibilities are only limited by the imagination of the musician.

In accordance with the present invention, the present controller is illuminated. This novel feature has many advantages. Most notably, the present invention provides a visually entertaining aspect to a musical presentation. In alternate aspects, the controller may be illuminated continuously, or intermittently. Similarly, it may be illuminated constantly with only one color, or with changing colors, or with changing intensities of one or more colors. Moreover, it may be continuously illuminated with a first color, and then periodically illuminated with other color(s) when moved to different angular positions. The possibilities are endless, and are limited only by the imagination of the person operating the musical controller.

In various embodiments, the at least one light source may be one or more LEDs (light emitting diodes) positioned at either or both ends of the light transmitting body.) Advantages of using an LED light source include its high brightness, and low wattage. In addition, LED light sources have the advantage of being easily controlled to vary between emitting different colors, and/or different lighting intensities. One or more fans may also be included for cooling the light source. The LEDs may also be mounted onto a heat sink which is then cooled by a fan.

The light transmitting body may be transparent or translucent, and made of acrylic. Optionally, the light transmitting body may comprise a plurality of separate segments, each with its own dedicated light source, and with each segment reflecting light internally. Thus, each of the different segments can be individually lighted, and with different colors being used for the different segments, adding to the entertaining effects of the visual presentation accompanying the music.

DETAILED DESCRIPTION OF THE DRAWINGS

Figure 1:
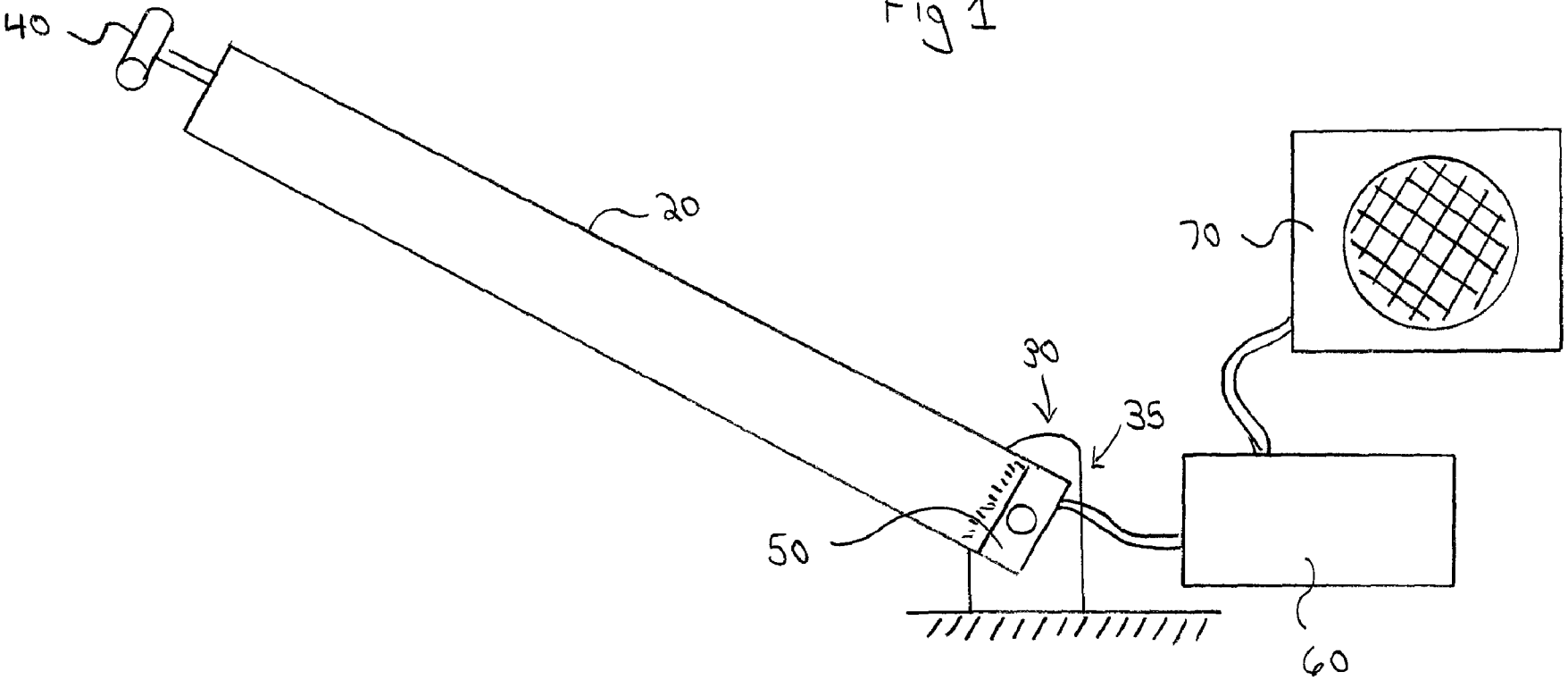
FIG. 1 is a side elevation view of the illuminated controller in a first position.

As seen in the attached Figs., the present invention provides an illuminated controller 10 for a musical control channel, comprising: a light transmitting body 20; a mounting system 30 holding a bottom end of the light transmitting body such that the light transmitting body can be positioned at different angular positions; a handle 40 at a top end of light transmitting body 20; at least one light source 50 positioned to illuminate light transmitting body 20; and an actuator 35 connected to mounting system 30, wherein actuator 35 translates the angular position of light transmitting body 20 into a signal for controlling a musical control channel.

In one embodiment, the light transmitting body 20 is made of acrylic. Light source(s) 50 may optionally be an LED (light emitting diode) light, but alternate lighting systems are also suitable. When light source 50 is mounted at (either) end of light transmitting body 2, as shown, the light emitted into the acrylic block will be internally reflected throughout the illuminated block, causing the entire block to appear as a bright "glowing" block of material. In alternate embodiments, the block of light transmitting body 20 may be transparent or translucent. It may have clear or frosted edges (depending upon the desired visual effect to be achieved).

Figure 2:
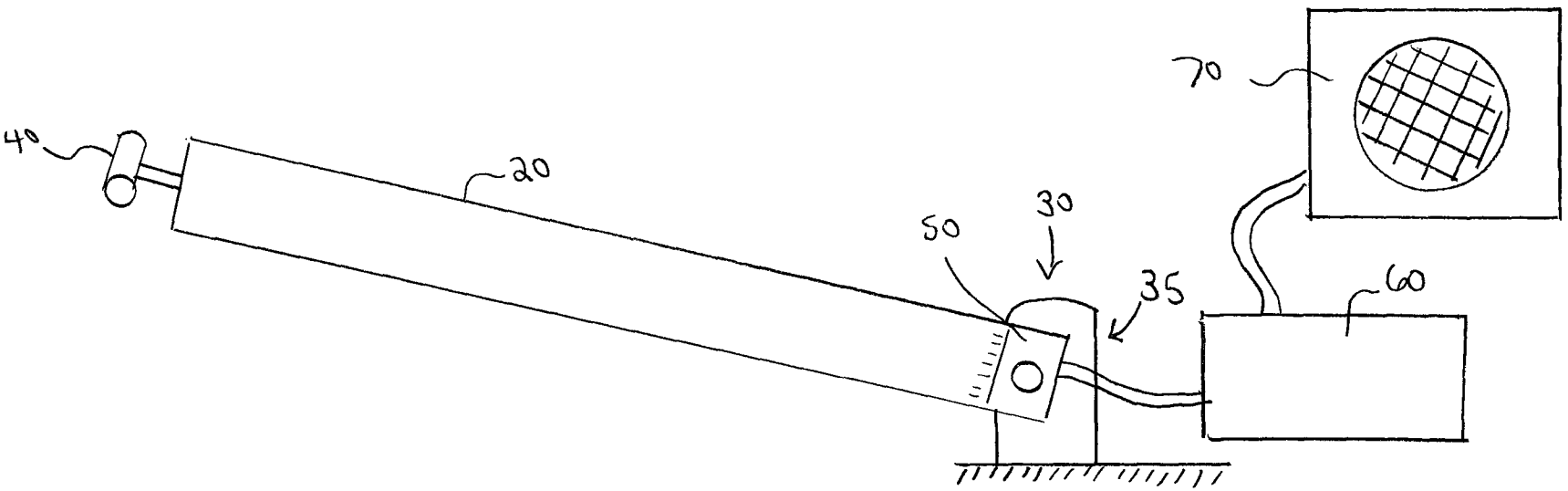
FIG. 2 is a side elevation view of the illuminated controller in a second position.

In operation, the musician grasps onto handle 40 and moves illuminated controller 20 from a first position (FIG. 1) to a second position (FIG. 2). Actuator 35 translates the angular position of illuminated controller 20 into an electrical signal that is fed into MIDI (or MIDI-type) controller 60. MIDI controller 60 then sends signals to speaker 70, where the effects of movement of illuminated controller 20 are heard.

When operated, the position of illuminated controller 20 controls one (or more) MIDI (or MIDI-type) music control channels. Such control channels may include sound characteristics such as volume, pitch, vibrato, tempo, panning, etc., and are well known in the art. Thus, depending upon which musical channel in MIDI controller 60 the illuminated controller 20 is hooked into, the position of illuminated controller 20 will control that particular musical channel. For example, the channel "pitch" may be pre-selected by the musician. By raising the position of illuminated controller 20 from the position in FIG. 2 to the position in FIG. 1, the musician may thereby increase the pitch of the music. In many respects, the present controller thereby functions the same as a simple dial or slider switch on a MIDI controller. What is fundamentally different about the present controller, however, is that it is illuminated. This feature adds to the pleasing experience of the musical performance. For example, the musician may be playing a keyboard, drums or other instrument, or be a singer. At different times during the performance, the musician my reach over and vary the angular position of illuminated controller 20, thereby changing the sound characteristics of the performance. The audience both hears the change in sound, and may also see a change in lighting (and appearance) in the controller itself.

Figure 3:
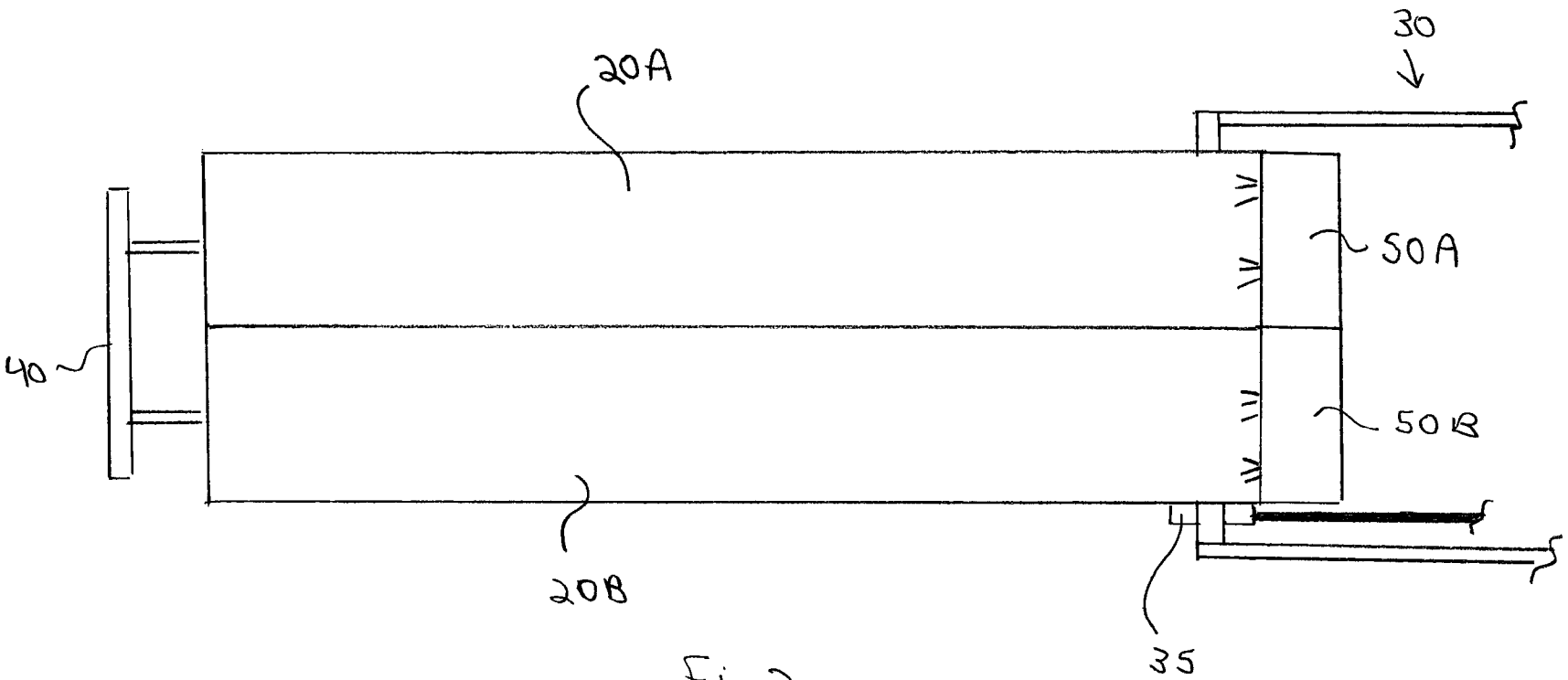
FIG. 3 is a bottom plan view of the illuminated controller.

As seen in the bottom view of FIG. 3, the light transmitting body of illuminated controller 20 may optionally be made of a pair of separate segments 20A and 20B positioned side-by-side, with each segment 20A and 20B reflecting light internally. In this embodiment, dedicated light sources 50A and 50B are positioned at the bottom ends of the light transmitting body segments 20A and 20B. Light source 50A may emit a red color causing segment 20A to glow with a red color. Similarly, light 50B may emit a green color causing segment 20B to glow with a green color. The lighting possibilities are endless. For example, the present system may be set up so that segments 20A and 20B are illuminated differently when at different angular positions. For example, when illuminated controller 20 is raised to the position shown FIG. 1, (red) light source 50A may be turned on and (green) light source 50B may be turned off. The illuminated controller 20 will have a bright red glow. This may be reversed when illuminated controller 20 is lowered to the position shown FIG. 2. I.E: (red) light source 50A may be turned off and (green) light source 50B may be turned on. The illuminated controller 20 will then have a bright green glow. At intermediate positions, both light sources 50A and 50B may be emitting light (with respective intensities depending upon the angular position of illuminated controller 20).

It is to be understood that many alternate designs are also possible. For example, the light transmitting body 20 may be made of only one segment, or two or more segments. Also, the light source(s) 50 may be positioned at the bottom or top ends, or both ends or even the sides of light transmitting body 20. In embodiments with multiple segments (e.g.: 20A and 20B), each light source (50A and 50B) may be delivering a different color and/or light intensity into its dedicated segment. As a result, a each segment 20 may display a different color, and/or change color independently.

In further optional embodiments, mounting system 30 may be configured to be moved in more than one (angular) dimension. For example, it could optionally be moved rotationally back and forth as well as up and down. Optionally, movement in different perpendicular) directions may control different musical control channels. Thus, an operator may control a first musical channel with movement in a first direction, and a second musical channel with movement in a second direction.

What is claimed is:

1. An illuminated controller for a musical control channel, comprising:

a transparent or translucent block of light transmitting material;

a mounting system holding a bottom end of the block of light transmitting material such that the block of light transmitting material can be positioned at different angular positions;

a handle at a top end of the block of light transmitting material;

at least one light source positioned to illuminate the block of light transmitting material, wherein light emitted by the at least one light source is internally reflected in the transparent or translucent block of light transmitting material causing the entire block of material to glow; and an actuator connected to the mounting system, wherein the actuator translates the angular position of the block of light transmitting material into a signal for controlling a musical control channel.

2. The illuminated controller of claim 1, wherein the at least one light source is positioned at the bottom end of the block of light transmitting material.

3. The illuminated controller of claim 1, wherein the at least one light source is positioned at the top end of the block of light transmitting material.

4. The illuminated controller of claim 1, wherein the at least one light source is an LED.

5. The illuminated controller of claim 1, wherein the light transmitting body is transparent.

6. The illuminated controller of claim 1, wherein the light transmitting body is translucent.

7. The illuminated controller of claim 1, wherein the block of light transmitting material is made of acrylic.

8. The illuminated controller of claim 1, wherein the block of light transmitting material comprises a plurality of separate segments, and wherein each separate segment has its own dedicated light source.

9. The illuminated controller of claim 8, wherein the separate segments are separate blocks of light transmitting material positioned side-by-side, and wherein each separate segment has its own dedicated light source, with each segment reflecting light internally such that different lighting effects are produced in the separate segments of the illuminated controller.

10. The illuminated controller of claim 1, further comprising:

a musical control channel controller in electrical communication with the actuator.

11. The illuminated controller of claim 10, wherein the musical control channel controller is a MIDI controller.

* * * * *